US009616322B2

(12) United States Patent
McKee et al.

(10) Patent No.: US 9,616,322 B2
(45) Date of Patent: Apr. 11, 2017

(54) CARD GAME AND GAMING SYSTEM HAVING COMMUNITY CARDS INCLUDING COMMUNITY WILD CARD

(71) Applicant: Poker Gone Wild, LLC, Benbrook, TX (US)

(72) Inventors: Ricky Don McKee, Everman, TX (US); Phillip Paul McKee, Everman, TX (US); Michael Don McKee, Everman, TX (US)

(73) Assignee: Poker Gone Wild, LLC, Benbrook, TX (US)

( * ) Notice: Subject to any disclaimer, the term of this patent is extended or adjusted under 35 U.S.C. 154(b) by 0 days.

(21) Appl. No.: 14/976,792

(22) Filed: Dec. 21, 2015

(65) Prior Publication Data

US 2016/0175695 A1 Jun. 23, 2016

Related U.S. Application Data

(60) Provisional application No. 62/124,447, filed on Dec. 20, 2014.

(51) Int. Cl.

| | |
|---|---|
| ***A63F 1/00*** | (2006.01) |
| ***G07F 17/32*** | (2006.01) |
| *A63F 3/00* | (2006.01) |

(52) U.S. Cl.

CPC ..... *A63F 1/00* (2013.01); *A63F 3/00157* (2013.01); *G07F 17/32* (2013.01); *A63F 2001/005* (2013.01); *A63F 2003/0017* (2013.01); *A63F 2003/00164* (2013.01); *A63F 2003/00167* (2013.01)

(58) Field of Classification Search

CPC ..... A63F 2001/005; A63F 2003/00164; A63F 2003/00167; A63F 2003/0017

USPC ..... 273/292, 274, 309; 463/12

See application file for complete search history.

(56) References Cited

U.S. PATENT DOCUMENTS

| | | | | |
|---|---|---|---|---|
| 4,743,022 | A | 5/1988 | Wood | |
| 4,836,553 | A | 6/1989 | Suttle et al. | |
| 5,288,081 | A | 2/1994 | Breeding | |
| 5,810,361 | A | 9/1998 | Kadlic | |
| 6,517,072 | B1 | 2/2003 | McInerney | |
| 6,669,198 | B2 | 12/2003 | Wichinsky | |
| 6,871,856 | B1 | 3/2005 | Rozboril | |
| 2002/0125639 | A1 | 9/2002 | Wells | |
| 2002/0125642 | A1 * | 9/2002 | Wells | A63F 3/00157 273/292 |

(Continued)

*Primary Examiner* — Benjamin Layno

(74) *Attorney, Agent, or Firm* — Weide & Miller, Ltd.

(57) ABSTRACT

A system and method for playing a card game is provided. The play may occur in a casino using a standard deck of cards with players making an ante wager, optional second wager, a third wager, and optional bonus event wager. Players are dealt two cards face down (player viewable only), two shared community cards which are dealt face down, and one or more shared community joker value cards. A player first makes an ante wager and then an optional second wager based on the player's impression of the player dealt cards. Then, a first community card is revealed to the player and the player provided an opportunity to make an optional third wager, which is required to continue game play. If a third wager is placed, the dealer reveals the second community card and the player's five card hand and bonus event hand is evaluated for a winning outcome.

20 Claims, 6 Drawing Sheets

(56) References Cited

U.S. PATENT DOCUMENTS

| | | | | |
|---|---|---|---|---|
| 2002/0175468 | A1 | 11/2002 | Kenny et al. | |
| 2004/0033824 | A1 | 2/2004 | Fitzhugh | |
| 2008/0073846 | A1* | 3/2008 | Lo | A63F 1/00 273/292 |
| 2013/0157752 | A1* | 6/2013 | Yoseloff | G07F 17/3244 463/25 |

* cited by examiner

CARD GAME AND GAMING SYSTEM HAVING COMMUNITY CARDS INCLUDING COMMUNITY WILD CARD

1. PRIORITY CLAIM

This application claims priority to and the benefit of U.S. provisional patent application 62/124,447 filed on Dec. 20, 2014, which is incorporated herein in its entirety.

2. FIELD OF THE INVENTION

The present invention relates generally to a system and method for playing games of chance, and more particularly to a system and method for a table game at a gaming table or video game at a gaming machine.

3. RELATED ART

Generally, casinos provide a variety of games for gamblers to wager the more popular include Blackjack, Pai Gow Poker, Poker and its variations, Keno, Baccarat, Roulette, and Craps. Despite the familiarity of these games, gamblers, particularly the regulars, frequently tire of playing the same games with the same rules and the same odds of winning. As a result, gamblers may tend to become disinterested or gamble less.

Accordingly, casinos are frequently looking for new games to offer to its clientele. This will attract new players and incentivize existing customer to play more often. New games need to be easy to understand, interesting, and allow for a high rate of card play for both regular gamblers and the average person on vacation one particular concern for casinos is that the average person on vacation, may not have a familiarity with many of the wagering games. This average person is likely to be unwilling to sit down for an extended period of time to learn a new game, often at great expense in lost wagers or time. Rather, the average person is more interested in the social interaction that comes with casino gambling and the possibility of winning.

Examples of new games that have been introduced in the past include Caribbean Stud, which is described in U.S. Pat. No. 4,836,553, issued to Suttle, et al., and Let It Ride, which is described in U.S. Pat. No. 5,288,081, issued to Breeding. These games have had considerable success and are characterized by having simple to understand rules and a fast rate of play. The games also allow the gamblers to interact within a social environment.

SUMMARY

To overcome the drawbacks of the prior art and provide other benefits, a new method and apparatus for game play is disclosed in the form of a table game or video game. Disclosed herein is a method of playing a card game that includes providing a physical deck of playing cards at a gaming table such that the physical deck of playing cards comprises at least a fifty-two card deck. The method of play includes receiving a first wager for a base game and an optional bonus event wager. The base game forms a five card hand and the bonus event wager is based on a four card hand. After the ante wager at the gaming table, the dealer or other element deals two cards to a player from the physical deck of playing cards as part of the base game and the bonus event. The dealer or other entity also deals a first community card and a second community card, both face down, to a community card area. The method of play then has an optional second wager opportunity from the player. The method of play then reveals the first community card, and then the player may place an optional third wager during the base game. Responsive to the player not placing the optional third wager, the method of play defines that the dealer determine if the player placed the bonus event wager and if the bonus event wager was placed, evaluating the player's four card hand. In this embodiment the four card hand comprises the two cards dealt to the player, the first community card, and a community wild card. If the four card hand is a winning outcome the player is provided an award. Responsive to the player placing the optional third wager, revealing the second community card and then evaluating the player's five card hand comprising the two cards dealt to the player, the first community card, the second community card and the community wild card to determine if the five card hand is a winning outcome, such that if the five card hand is a winning outcome the player is provided an award. If the player placed a bonus event wager the dealer or other element evaluates the player's four card hand. The four card hand comprises the two cards dealt to the player, the first community card, and a community wild card. Evaluation occurs to determine if the four card hand is a winning outcome, such that if the four card hand forms a winning outcome the player is provided an award.

In one embodiment, the first wager must be the same amount as the second wager. The second wager may be an optional wager. In one configuration, the award may be proportional to the amount wagered or when wagers are placed during game play. For example, wagers placed late in the game, when several cards have been revealed to the player, are payed at a lower rate, than wagers placed before any cards are revealed to the player. In one embodiment the award amount is based on the selected pay table. The community cards may be shared with other players or separate community cards may be designated for each player. In one embodiment, the wild community card is printed on the gaming table.

Also disclosed is a method of playing a card game that includes providing a physical deck of playing cards at a gaming table. The physical deck of playing cards comprises at least fifty-two cards. The method of play may be guided or overseen by a dealer or other element or entity. The method of play receive includes receiving a first wager for a base game such that the base game forms a base game card hand. At the gaming table, the dealer deals one or more cards to a player from the physical deck of playing cards and deals one or more community cards to a community card area. The player may place an optional second wager and then the dealer reveals a first community card from the one or more community cards. The player may then place an optional third wager during the base game which is required to continue play. Responsive to the player not placing the optional third wager the game is ended for that player and the dealer collects wagers made by the player. Responsive to the player placing the optional third wager, the game play directed by the dealer reveals at least a second community card from the one or more community cards and evaluates the player's card hand. The card hand comprises the one or more cards dealt to the player, the one or more community cards, and a community wild card to determine if the base game card hand is a winning outcome, such that if the base game card hand is a winning outcome, providing the player an award.

In one embodiment this method of game play further comprises receiving a bonus wager, determining if the player placed the bonus wager, and if the bonus event wager was placed, evaluating a bonus card hand to determine if the bonus card hand is a winning outcome. The bonus card hand is formed by fewer cards than the base game card hand. If the bonus card hand is a winning outcome, providing the player an award.

The base game card hand may comprise of four dealt cards and the community wild card. In one configuration, the bonus card hand consists of three dealt cards and the community wild card. Reshuffling may occur after each game or a newly shuffled deck may be used for each base game. The first wager and the second wager may be required to be of the same amount. In one variation the award provided to the player is related to the first and second wager on the selected pay table. For example, it may be based on timing of the first and second wager, whether a first or second wager is placed, and/or the amount of the first and second wager.

Also disclosed is a gaming machine comprising a controller, at least one electronic display, at least one player input device on the gaming machine, a monetary acceptor configured to receive a ticket or monetary value from a player to establish credits on the gaming machine, such that the credits are wagerable via the player input device. Also part of the gaming machine is memory storing machine-readable code such that the machine-readable code is executable by the controller to present a base game at the gaming machine. The base game includes the following steps which include receiving an first wager for a base game to form a base game card hand and dealing one or more cards to a player, and displaying the one or more cards to the player on the electronic display, and dealing one or more community cards to a community card area. In one embodiment, the one or more community cards are displayed on the electronic display face down. The gaming machine receives an optional second wager from the player via the player interface and then reveals on the electronic display a first community card from the one or more community cards. The gaming machine receives an optional third wager during the base game via the player interface. Responsive to the player not placing the optional third wager, ending the base game and collecting the first and second wager made by the player. Responsive to the player placing the optional third wager, revealing on the electronic display at least a second community card from the one or more community cards. The machine readable code is further configured to evaluate the player's card hand formed from the one or more cards dealt to the player, the one or more revealed community cards, and a community wild card to determine if the base game card hand is a winning outcome. If the base game card hand is a winning outcome, providing the player an award.

In one configuration, the machine readable code is further configured to receive a bonus wage via the player interface, if the player placed the bonus wager, evaluate a bonus card hand to determine if the bonus card hand is a winning outcome. The bonus card hand is formed by fewer cards than the base game card hand. If the bonus card hand is a winning outcome, providing the player an award.

In one embodiment, the base game card hand consists of two cards dealt to the player, two community cards and the community wild card. In one embodiment, the bonus card hand consists of two cards dealt to the player, one community card, and the community wild card. It is contemplated that the machine readable code may be configured to reshuffle after each game. In one variation, the first wager and the second wager must be of the same amount. For the award, the award provided to the player may be related to the first, second, and third wager amount from the selected pay table.

In one embodiment a wager on the optional card value may be used with the community cards to make a winning hand if the hand comprising of at least three of a kind, straight, flush, full house, four of a kind, straight flush, royal flush, and five of a kind. A wager on the river, or last card value may be used with the community cards to make a third winning hand, the first winning hand comprising at least a straight, flush, full house, four of a kind, straight flush, royal flush, and five of a kind. In one embodiment a wager on the bonus hand formed from the player's first two dealt cards and first community card and joker value card printed on the layout and determination is made whether or not the player has a winning five card poker hand. The bonus event card hand is a winning outcome if the hand comprises at least three of a kind, straight, flush, four of a kind, straight flush.

In accordance with another embodiment, a computer system and a video terminal is provided that allows a player to play a virtual card game via the video terminal. A mobile device may also be used for game play.

Accordingly, an object of the present invention is to provide a system and method for providing a card game suitable for casino play in multiple formats, such as at a table, a video terminal, or the like.

Also disclosed is a method for playing a card game that includes providing a deck of cards having plurality of colors a plurality of values and receiving an ante wager and an optional bonus wager. Then, the dealer deals two player dealt cards and the player may decide to make another optional wager, which may be required to be the same as the original wager, or the player may decline to make a second wager. The dealer then reveals one community card and allows the player to use the one community card and a wild value card symbol printed on the layout to be used as a fourth card of the player's choice to improve their hand. The player may then wager a final river bet or fold their cards.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games. Other embodiments of the invention comprise systems and/or devices for presenting games.

The making and using of the presently preferred embodiment is discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention. The present invention will be described with respect to preferred embodiments in a specific context, namely a casino card game. The invention may also be applied, however, to other individual or group video games on video poker-style machines, PDAs, mobile units, laptop computers, desktop computers, or the like.

Figure 1:
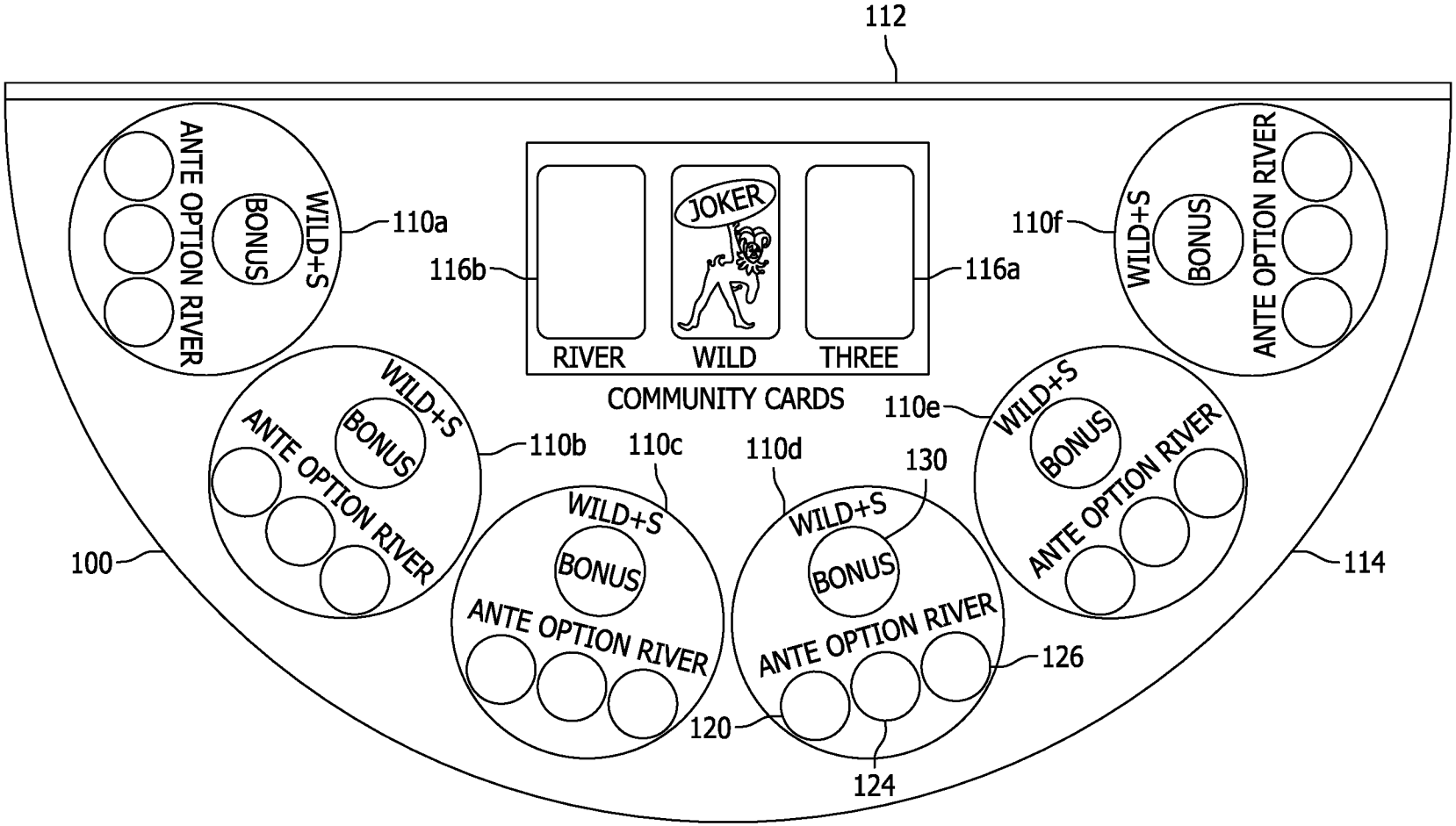
FIG. 1 is table layout that may be used to play a card game in accordance with the embodiment of the present invention.

With reference now to FIG. 1, there is shown a table layout 100 that may be used in embodiment of the present invention. It should be noted that the table layout illustrated in FIG. 1 is provided for illustrative purposes only, and that embodiments of the present invention may be utilized with many different table designs and layouts. The table layout 100 comprises six player positions 110*a-f* and a dealer location 112 positioned at approximately opposing sides of a table 114. The player positions 110 include wager placing locations defines as the ante wager (first wager) location 120, the option wager (second wager) location 124, a river wager (third wager) location 126, and a bonus event wager (bonus wager) location 130. The table layout 100 identifies each player location by symbols commonly used to identify a place to make a value bet wager. The table layout 100 includes locations to make the ante bet, optional bet, river bet and bonus bet. The table layout further includes locations for two community cards 116 and the use of a wild joker card 117 printed on the table felt or otherwise displayed or designated on the table top. The use of the community cards 116 and the joker 117 will be discussed below.

In a preferred embodiment, the underlying games are presented in traditional format using one or more standard 52 card decks (13 cards of A, K, Q, J, 10, 9, 8, 7, 6, 5, 4, 3, and 2, in each of the suits of Hearts, Diamonds, Clubs and Spades). The cards may be physical playing cards or cards represented on a computer screen. Of course, other decks of cards (such as including bonus or wild cards, etc.) might be used. During game play one or more wagers are made. As is known, the wager preferably comprises monies (coins, paper currency) or monetary equivalent (such as physical chips or credits). Of course, the form of the wager and how it is presented and accepted may vary. For example, if the game is presented at a table using physical cards, the player may place the wager using physical chips handled by a player. Any type of table may be used for standing or seated play, either live or virtual. The may have legs and a playing surface supported by the legs. If the game is presented at an electronic gaming machine, the player may place the wager by providing monetary value to the gaming machine and then wagering one or more credits. Of course, other forms of wagers may be utilized including points, free games, etc.

It is also contemplated that the table may include a dealer card hand area such that cards may be dealt to the dealer to form a dealer card hand which the player must play against, such as is the case in the game of black jack. As with the prior embodiment, the dealer may utilize the community cards as do the players in their card hands. It is also contemplated that the deck of physical cards may optionally include one or more wild cards or jokers to increase winning options or excitement during game player or the table may include more than one wild card printed thereon. If a wild card is included in the deck of physical cards the pay tables or which hands qualify as winning hands may need to be modified based on a change in the odds.

Figure 2:
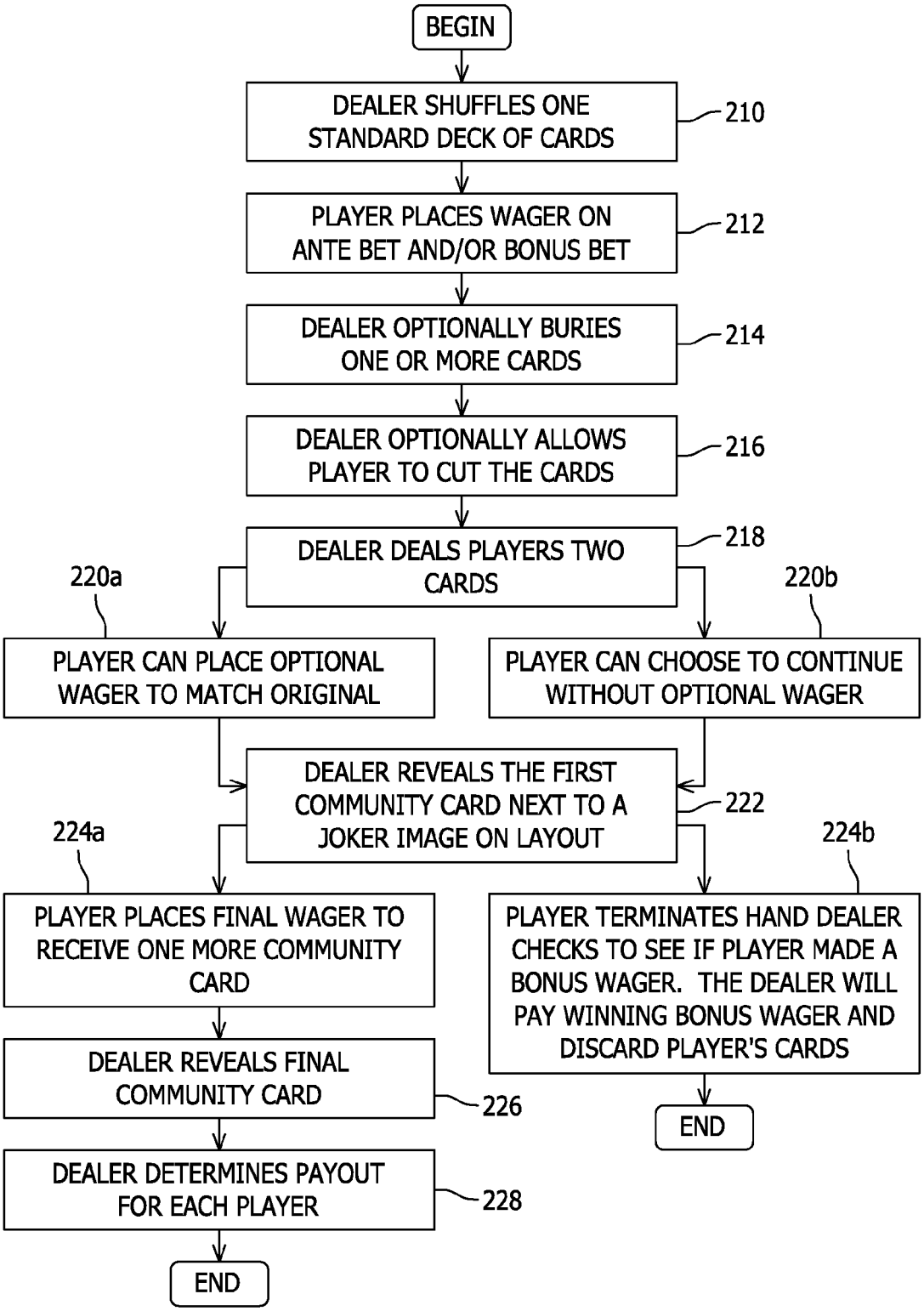
FIG. 2 is an operational flow diagram illustrating the process used to play a card game in accordance with the embodiment of the present invention.

FIG. 2 is an operational flow diagram illustrating a flow of a card game in accordance with an embodiment of the present invention. The game begins at a step 210, wherein a dealer shuffles one or more standard deck of cards less the jokers. Each deck of cards may include 52 cards. In other embodiments, the jokers may be used. In the present embodiment, one deck of cards is shuffled after each hand. As a result, because each hand utilizes no more than 14 cards, it is not necessary to utilize more than one deck of cards. In other embodiments more than one deck of cards may be used and shuffling may occur less often.

At a step 212, the player places a wager and the dealer verifies that the player has placed the desired wagers. It should be noted that wagers may be placed, or changed, at any time while the deck is being shuffled up to the point at which the dealer is prepared to deal the cards to the players. To participate in the game, the players make wagers by placing money or tokens (or any other wager method whether physical or electronic) on the table at the location indicating the Ante bet location 110*a-f* and or the Bonus bet location 110*a-f* Reference is made in the discussion of FIG. 2 to the elements of FIG. 1.

Steps 214 and 216 represent two optional steps. At a step 214, the dealer may optionally bury one or more cards by taking one or more cards from the top of the deck and placing them on the bottom of the deck or in the deck or in the discard holder. At a step 216, the dealer may cut the deck or allow someone else (e.g., a player) to cut the deck. The deck may be cut by removing a portion of the top cards on the deck for the dealer to place on the bottom, or by placing a colored card indicator into the deck to indicate to the dealer where the deck is to be cut.

Next, at a step 218, the dealer will now deal each player a card (face down) and place one card down on the first community card place (face down) as labeled in FIG. 1 location 116A on the table. The dealer will now continue to deal each player a second card and place a final community card as labeled in FIG. 1 at the final location 116B on the table. Thereafter, the dealer can optionally discard the rest of the deck of cards in the discard holder. In other embodiments one or more cards may be dealt face up.

Next at a step 220*a*, the player will now review the two cards dealt to decide whether to or not make an optional wager. In one embodiment, the optional wager must be of the same value as the original ante bet. As such, the wager is placed in the location shown as optional bet location in the betting locations 110*a-f* (designated as option). This option wager is for players who want to wager more money on hopes of a winning hand, such as if the player has received good cards thus far in the game. The option wager is optional and thus the player may choose not to wager any more on the current hand 220*b* and can do so by acknowledging to the dealer that no wager will be made or simply not making a wager. In other embodiment, the option wager may be made for a value other than the ante wager, but such could affect the math and payouts for the game.

Next at step 222, after the players have decided whether to wager the optional bet (option wager) or to decline, the dealer will reveal the first community card. The player has now a total of four cards, namely the two cards dealt to the player, the first community card dealt to location 116A, and the exposed joker played as a wild card ($4^{th}$ card) which is printed on the layout location FIG. 1 location 117.

Next the method of game player proceeds to a step 224*a* or a step 224*b*. At a step 224*a* and 224*b*, the player reviews the four cards to decide whether to place a wager on the river bet or to fold their hand. If the player wishes to continue with the hand and the wagering game, a wager of the same value as the original bet must be placed in the location shown as the river bet location 110*a-f* in FIG. 1. Then, the player places the two cards dealt to the player underneath the final wager (river wager) and the dealer will proceed after all players have made their decision for this step of the game.

At a step 224*a* if the player wishes not to go further with the game and not place any additional wagers, the player will discard the two dealt cards and not make the river wager.

For these players, the dealer next determines see if the player wagered a bonus bet in the bonus wager location in area 110*a-f*. If the player has wagered this four card bonus bet the dealer will reveal the player's two cards and verify if the player has a winning four card poker hand combining the player's two dealt cards, the first community card 116*a* and the joker location 117 printed on the table layout. If the player has made a four card poker hand which results in a winning outcome, the player is provided an award for that wager. In one embodiment, winning outcomes on the bonus wager include three of a kind, flush, straight flush, or four of a kind the player will be paid according to the pay table printed on the layout or posted on the table. The dealer will now collect the player's cards and place them in the discard holder. This occurs for each player who has made the bonus wager but not made the river wager.

Next step 226, the dealer will now reveal the last community card at location 116*b*, which is labeled as the river card. After displaying the card, the dealer interacts with each player and player hand, beginning to the left, and reveal each player's two dealt cards and verify if the players have a winning five card poker hand, and a four card poker hand (bonus wager hand) if the player has wagered this bonus bet. The five card hand is formed by the player's two cards, the joker at location 117 and the two other dealt shared cards at locations 116*a*, 116*b*. The best hand is formed from each player's five card hand and four card hand (if the bonus wager was placed). The player is paid an award for a winning outcome according to the pay table posted or printed on layout for each five card hand and four card hand. The dealer then discards the player's two dealt cards. The dealer continues until all players cards have been verified in this manner such that each hand is reviewed to determine if there is a winning outcome and if so, an award provided. The remaining cards placed in discard holder and prepares the deck of cards for next hand. In one alternative embodiment a different number of cards may be used, such as seven cards, or any number of cards. When the number of cards used to form the hand varies, so too could the number of cards dealt to the player or to the community area, and a greater number of wild cards may be part of the community cards. For example, there may be four or five community cards. The resulting hand may still be five cards, or a greater or lesser number. Player cards may be dealt face up or face down.

When implemented on a gaming machine, the machine readable code executing on a processor in connection with a gaming machine would act as the dealer by presenting the game, receiving wagers, determining winning outcomes and providing awards in the form of credits or tickets.

The following illustrates exemplary payouts for an ante wager, optional wager, river wager. Other pay table may be used.

| | Ante bet | Optional bet | River bet |
|---|---|---|---|
| Five of a kind | 200 to 1 | 50 to 1 | 20 to 1 |
| Royal flush | 50 to 1 | 20 to 1 | 10 to 1 |
| Straight flush | 20 to 1 | 6 to 1 | 6 to 1 |
| Four of a kind | 10 to 1 | 6 to 1 | 5 to 1 |
| Full house | 6 to 1 | 5 to 1 | 4 to 1 |
| Flush | 5 to 1 | 4 to 1 | 3 to 1 |
| Straight | 4 to 1 | 3 to 1 | 1 to 1 |
| Three of a kind | 1 to 1 | 1 to 1 | push |

The following illustrates payouts for the 4 card poker bonus wager. Other pay table may be used.

| | |
|---|---|
| Four of a kind | 20 to 1 |
| Straight flush | 15 to 1 |
| Flush | 3 to 1 |
| Straight | 2 to 1 |
| Three of a kind | 1 to 1 |

Although the present invention and its advantages have been described in detail, it should be understood that various changes, substitutions and alterations can be made herein without departing from the spirit and scope of the invention as defined by the appended claims. For example, payout schedules, table layout, bets, and the like may be altered to offer players variations of embodiments of the present invention while remaining within the scope of the present invention.

Moreover, the scope of the present application is not intended to be limited to the particular embodiments presently existing or later to be developed, that perform substantially the same function or achieve substantially the same result as the corresponding embodiments describe herein may be utilized according to the present invention.

Figure 3:
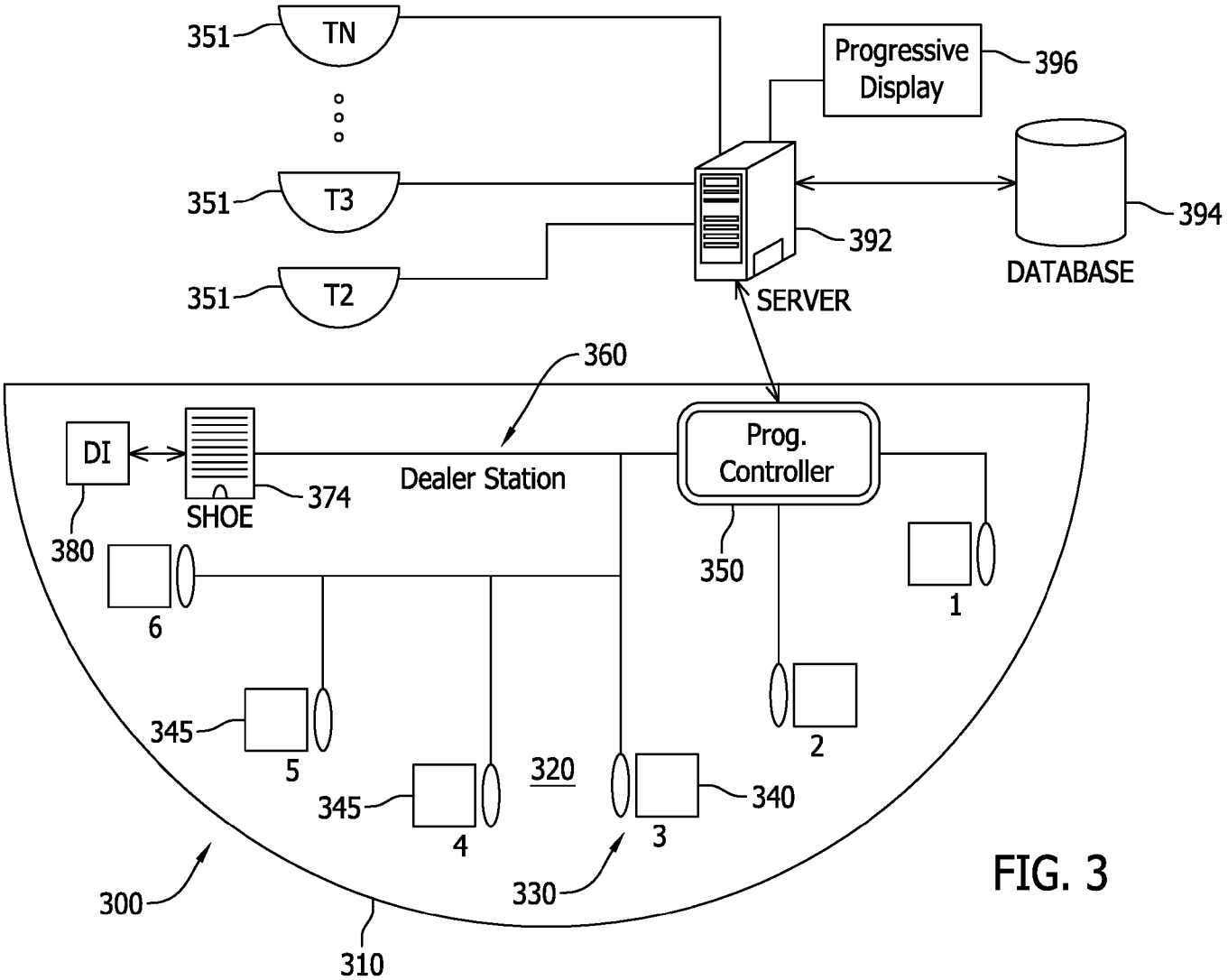
FIG. 3 is an exemplary gaming table with a progressive networked across multiple tables.

FIG. 3 illustrates a block diagram of an example embodiment of a gaming table 300 with network communication system. This is but one possible table arrangement and layout and it is contemplated that one of ordinary skill in the art may arrive at other table arrangements to promote game play or accommodate a greater or fewer number of players. For example, it is contemplated that the method and apparatus described herein may be utilized with any game layout. Likewise, the table can be configured in a stand-up or sit down arrangement.

In this example embodiment gaming table 300 includes an outer edge 310 surrounding a generally flat top surface 320. The table 300 may also be configured to accommodate other types of traditional table games including, but not limited to, any type of blackjack or poker wherein the house only receives a percentage or rake from the pot of money wagered by the players, baccarat, pai gow, proprietary table games, or non-proprietary card table games which may use any combination of dice, wheels, or cards. Traditional table games include games of chance that use cards or dice, and tokens (also denoted as gaming chips), currency, currency equivalents or credit vouchers which may be of differing values. Of course, any table game may be played in a tournament format. In this discussion, the table is configured for use with the game described in FIG. 2 and would have a different card layout and wager spot layout.

In this example embodiment of a gaming table 300, there is an outer edge 310 of the table. One or more player stations 330 (also denoted herein as player locations) are provided and configured for use by a player to participate in a wagering game or a game of chance offered at the table 300. In this embodiment, the player stations 330 comprise a player position 340 wherein a player is dealt playing cards and a player may place wager and accumulate tokens during the course of play. For example, the player may place original gaming chips (or tokens) and tokens that are won within the area of player position 340 during the course of play. This may include ante wagers and bonus bet wager.

In other embodiments, one or more progressive wager detectors 345 may be located in one or more other locations on the table surface 320 or be a separate device independent from the table 300. The progressive side wager detectors 345 may comprise a coin-in (or token) slot which accepts a coin or token or an RFID or optical detector which detects the side wager or progressive wager. The progressive wager may be for the bonus bet or another event, such as the five card hand. By way of example, a wager detector 345 may be associated with each player position 340 or may be shared by more than one player. In operation, when a player makes a wager, a player takes tokens from the player's token zone and places them in or on the wager detector 345.

In another embodiment, a portable Personal Bet Manager may be provided whereby a player may purchase credits which are registered or stored on the Personal Bet Manager.

Additionally, the table 300 may comprise supplement bet spots, token buy-in spots and the like. Optionally, in another embodiment of the table 300, the table's player positions 340 may be configured as card spots and associated card detection zones (not shown). Playing cards may be configured with elements detectable by the card detection zones. Such detection may be by various means including, but not limited to optical and UV scanning and radio wave scanning (better known as radio frequency identification or RFID).

The table may also comprise an optional electronic card reading shoe 374 configured to read the suit and rank of dealt cards. The shoe 374 may communicate with other elements of the table and progressive system. The shoe 374 may also perform card shuffling and present the cards for dealing. A dealer interface 380 is provided and may be connected to the shoe 374 to provide dealer control and to interface with the shoe, such as by providing information regarding cards dealt to the dealer.

The wager detectors 345 and optionally the shoe 374 electrically communicate with a progressive controller 350 that is associated with the table 300. The progressive controller 350 may be disposed, for example, under the table 300, or at a remote location. The shoe 374 or bet detection areas 345 may communicate to the progressive controller 350 to indicate to the progressive controller 350 when a player qualifies for, based on dealt cards, a progressive jackpot or award, and optionally the payout amount based on the cards dealt to the player. This information may be used by the dealer to assist in game play and track progressive participation. The progressive controller 350 records which player positions have placed a progressive wager to allow that player to participate in the progressive. The progressive controller 350 may also time stamp the time of the wager paid by a player or the dealing of cards to a player from the electronic shoe to establish a timing event for the player in relation the wager and secondary game. The controller 350 may also calculate the amount wagered for progressive participation for each table and communicate that to the server 392. Additional tables 351 may also be similarly configured and linked to either the controller 350 or server 392 as shown.

The progressive controller 350 is in communication (wired or wirelessly) with one or more servers 392. The servers 392 may be configured as is known in the art with a processor configured to execute non-transitory machine readable code (software) which is stored in one or more memories. There may be one or more other tables 351, numbered T2 thought TN, where N is any whole number in addition to the table 300. A progressive display 396 also connects to the server 392. The server 392, executing machine readable code, is configured to sum the progressive wagers and display the total possible amount to be won on the progressive display 396. By displaying the large potential progressive payout on the display 396, players are encouraged to play the base game and the progressive. One or more databases 394 are optionally provided to store data, machine readable code, or a combination thereof.

A player may receive cards from a dealer and place them on a player's card position 340. Each player's cards may be detected and monitored by the dealer in an associated card detection zone and the table may be equipped with RFID, overhead, dealer or player active detectors, or other card or token readers. The player positions 140 may also detect or provide space for wagers, such as progressive bets, that are placed and detected with the bet detectors 345. Without limiting the disclosure, it will be appreciated that the table 100 may comprise any number of or combination of player positions 340, detection spots and associated detection zones (bet detectors 345), and the like as discussed above to achieve operation as described herein.

In one example embodiment, the table 300 may comprise a dealer station 360 for a dealer. As is generally understood, the dealer may present the game from the dealer station 360 by dealing cards to players. The dealer station 360 is a location on or in some way associated with the table 300 and/or the dealer on which tokens or playing cards may be placed.

The dealer interface 380 (referred to as DI in FIG. 1) may also be placed near the dealer station 360. The dealer interface 380 comprises a user interface configured to allow the dealer to provide input to the shoe 374 and optionally receive output from the shoe, which can be presented to the dealer and the server 392. In various embodiments, the dealer interface 380 comprises one or more buttons, dials, display screens, LCD/touch screen, lights or other illumination devices, speakers or other audible indicators, or analog dials, potentiometers, or keypads. Through use of the dealer interface 380, the dealer is able to provide input to the shoe 374 or receive data from the shoe 374.

In yet another embodiment, the dealer interface 380 may be configured to communicate with a detection system (discussed above), a player tracking system (as monitored and controlled such as by one or more servers 392) and an accounting system.

In FIG. 3 the one or more components may all be integrated into a single device. For example, the dealer interface 380 may be part of the shoe/shuffler 374. In addition, the table may also include a player tracking device, such as a card reader and associated keypad. Such player tracking devices are well known and may permit the game operator to track play of players at the gaming table. The tracked play may be utilized to offer player bonuses or awards.

Servers 392 may additionally have other functions, such as tracking players to provide coupons (also termed "comps") based on various aspects of players' behaviors. Without limiting the scope of the disclosure, behaviors that may trigger an award of player comps and subsequent printing of player coupons include amounts wagered, won, or lost, number of hands played by the player, or random events, such as a mystery award. Input from a player tracking system may also be utilized. Furthermore, servers 392 may provide accounting and auditing functions during play of a game.

However, in another embodiment, the game is presented and played at a gaming machine. Such a gaming machine may have various configurations.

The gaming machine may be located at a casino (and as such is referred to as a "casino gaming machine"). The gaming machine may be part of a gaming system, such as a casino gaming system which links multiple of the gaming machines, one or more table games and other devices such as kiosks, accounting systems or servers, progressive systems or servers, player tracking systems or servers or the like.

Figure 4:
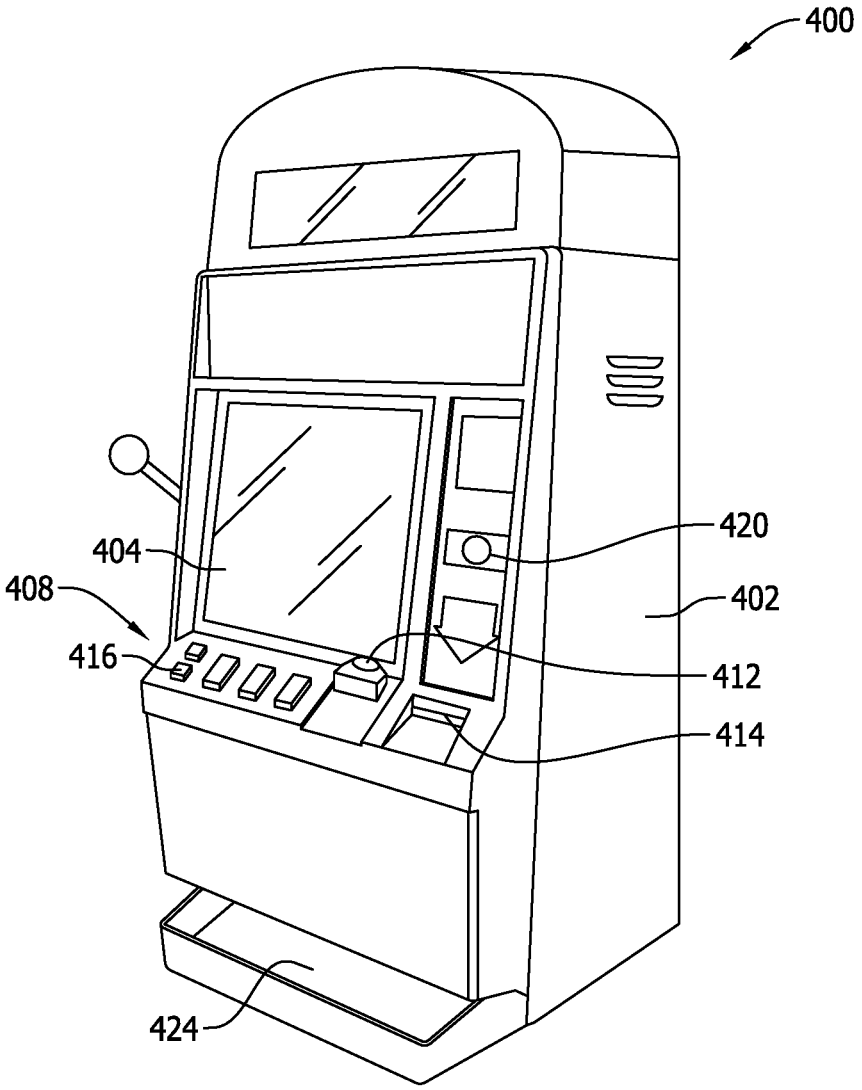
FIG. 4 is an exemplary gaming machine.

One configuration of a gaming machine 400 is illustrated in FIG. 4. As illustrated, the gaming machine 400 generally comprises a housing or cabinet 402 for supporting and/or enclosing various components required for operation of the gaming machine. In the embodiment illustrated, the housing 402 includes a door located at a front thereof, the door capable of being moved between an open position which allows access to the interior, and a closed position in which access to the interior is generally prevented. The configuration of the gaming machine 400 may vary. In the embodiment illustrated, the gaming machine 400 has an "upright" configuration. However, the gaming machine 400 could have other configurations, shapes or dimensions (such as being of a "slant"-type, "bar-top" or other configuration as is well known to those of skill in the art).

The gaming machine 400 preferably includes at least one display device 404 configured to display game information. The display device 404 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 404 may be capable of projecting or displaying a wide variety of information, including images, symbols and other indicia or information associated with game play, game promotion or other events.

As described in more detail below, the gaming machine 400 is preferably configured to present one or more games upon a player making a monetary payment or wager. In this regard, as described in more detail below, the gaming machine 400 includes means for accepting monetary value.

In one embodiment, as detailed above, certain game outcomes may be designated as winning outcomes. Prizes or awards may be provided for winning outcomes, such as monetary payments (or representations thereof, such as prize of credits), or promotional awards as detailed herein. As detailed below, the gaming machine 400 includes means for returning unused monetary funds and/or dispensing winnings to a player.

The gaming machine 400 preferably includes one or more player input devices 408 (such as input buttons, plunger mechanisms, a touch-screen display, joystick, touch-pad or the like). These one or more devices may be utilized by the player to facilitate game play, such as by providing input or instruction to the gaming machine 400. For example, such input devices 408 may be utilized by a player to place a wager or a side wager, cause the gaming machine 400 to initiate a game, to indicate cards to be held or discarded, to "cash out" of the gaming machine, or to provide various other inputs.

In one preferred embodiment, the gaming machine 400 includes at least one microprocessor or controller for controlling the gaming machine, including receiving player input and sending output signals for controlling the various components of the machine 400 (such as generating game information for display by the display 404). The controller may be arranged to receive information regarding funds provided by a player to the gaming machine, receive input such as a purchase/bet signal when a purchase/bet button 416 is depressed, and receive other inputs from a player. The controller may be arranged to generate information regarding a game, such as generating game information for display by the at least one display 404 (such as information representing images of displayed cards), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 400 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 400 may be configured to detect a wager, such as a signal from a player's depressing of the "bet one" button. Upon such an event and/or the player otherwise signaling the gaming machine to present the game, the controller may be configured to cause cards to be dealt/displayed on the at least one display 404. The controller may accept input from a player of a request to split, buy insurance, obtain additional cards or the like via the one or more player input devices 408 of the gaming machine 400.

The gaming machine 400 may be configured to generate and present games in a stand-alone manner or it may be in communication with one or more external devices at one or more times. For example, the gaming machine 400 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 400 is configured to present one or more wagering games. Thus, the gaming machine 400 is preferably configured to accept value, such as in the form of coins, tokens, paper currency or other elements or devices representing value such as monetary funds. For example, as illustrated in FIG. 4, the gaming machine 400 might include a coin acceptor 412 for accepting coins. Of course, associated coin reading/verifying devices and coin storage devices may be associated with the gaming machine 400 if it is configured to accept coins. Likewise, the gaming machine 400 might include a media reader 414. Such a reader may be configured to accept and read/verify paper currency and/or other media such as tickets. Of course, in such event the gaming machine 400 may further be configured with one or more paper currency or ticket storage devices, such as cash boxes, and other paper currency or media handling devices (including transport devices).

The gaming machine 400 might also be configured to read FOBs, magnetic stripe cards or other media having data associated therewith and via which value or funds may be associated with the gaming machine 400.

In one embodiment, the gaming machine 400 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 400 dispensing coins to a coin tray 424. In another embodiment, funds may be issued by dispensing paper currency. In yet another embodiment, a player may be issued a media, such as a printed ticket, which ticket represents the value which was paid or cashed out of the machine.

The gaming machine 400 may also include a player tracking device, such as a card reader and associated keypad 420. Such player tracking devices are well known and may permit the game operator to track play of players of the gaming machine. The tracked play may be utilized to offer player bonuses or awards.

It will be appreciated that the gaming machine illustrated in FIG. 4 is only exemplary of one embodiment of a gaming machine. For example, it is possible for the gaming machine to have various other configurations, including different shapes and styles and having different components than as just described.

For example, it is possible for the base game and side wager to be presented on a computing device, including at a home or office computer, a kiosk or other types of devices. For example, the game and side wager might be presented via an application running on a computing device, or in a server-based or "Internet" environment. In one embodiment, a player might log in to a casino server and the controller of the casino server may cause game information to be delivered to the player's computer and then be displayed on a display of the player's computer. In this regard, it will be noted that the term "controller" may comprise more than one device. For example, in a server-based environment, a controller at a server may generate game information and transmit that information to a local controller at a gaming machine. The local controller at the gaming machine may then cause game information to be displayed on the display of the gaming machine. The games of the invention could also be presented by or at hand-held devices, such as PDAs, cellular phones, tablet computing devices or the like.

A casino may have numerous such gaming machines 400, such as located on a casino floor or in other locations. Of course, such gaming machines 400 might be used in other environments, such as an airport, a bar or tavern or other locations.

The side wager may also be presented one or more gaming devices 400 as described above while being simultaneously presented to players at gaming tables 151. The display 404 of the gaming device may show the amount of the progressive jackpot similar to the progressive display 196.

Figure 5:
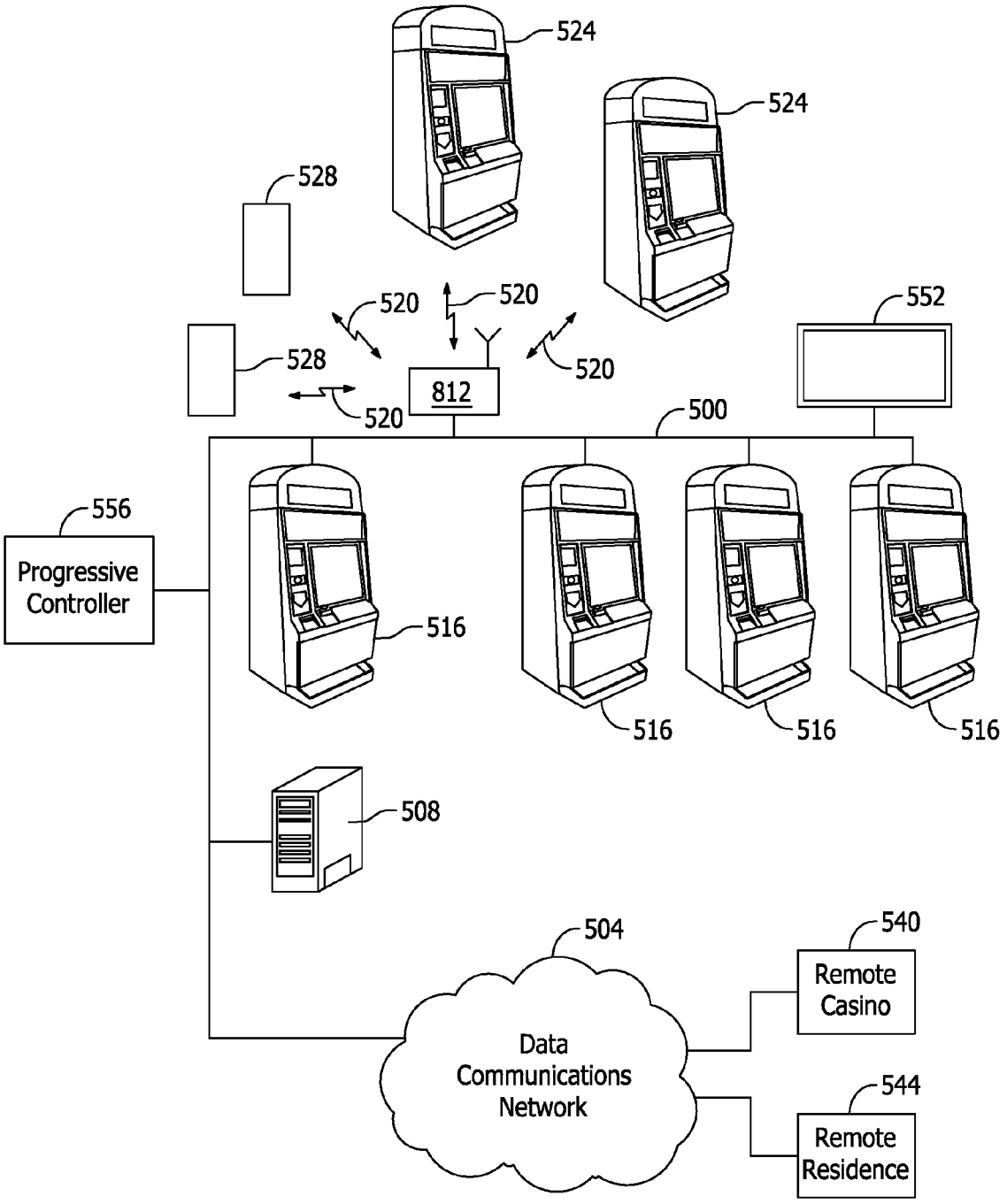
FIG. 5 illustrates exemplary networked gaming devices and gaming machines with an associated progressive.

FIG. 5 is a block diagram of an example gaming system with a server based network. The communications network 500, 504 connects to multiple devices as discussed below to enable communication between devices. The network 500, 504 may be any type network capable of exchanging data between devices. The network may include a local network 500 and an external network 504 such as for example the Internet, or an Intranet with appropriate security mechanisms. The wagering game network may include other network devices, such as one or more servers which may comprise accounting servers, wide area progressive servers, player tracking servers, game content servers, or any other type server.

In this embodiment, the gaming establishment at the top of the figure includes a network 500. As shown, the gaming network includes gaming machines 516 connected to the network 500 via a wired connection.

The network 500 may include a wireless device 512 capable of communicating over a wireless link 520 with one or more wireless gaming machines 524 or hand held gaming devices 528. A wagering game server 508 may serve wagering games on the gaming machines over the local area network 500 and function as a remote controller for the wagering games as described above.

The wagering network includes hardware and memory storing machine readable instructions and machine readable code for performing the operations described herein. Those of ordinary skill in the art will appreciate that each gaming establishment may include additional local area networks such which may serve to connect many other wagering games. Alternatively, multiple servers 508 may be used for the functions of the wagering game server which provide game content to the gaming machines 516, 524, 528.

The local area network may be any type of suitable property LAN configuration including, for example, a dedicated hardwired property LAN or a wireless property LAN. The local area network may be configured in any configuration or topology.

The local area network includes wired communication links 500 and wireless communication links 520. In this example configuration, the stand-alone gaming machines 516 communicate with the network 502, 508 via the wired communication links as shown. The stand-alone gaming machines 528 as well as the handheld gaming devices 528 communicate with the network 500, 508 via the wireless communication links 520. One or more wireless communication devices 512, with associated antennas, enables wireless communication. Other combinations of wired and wireless connections to different gaming machines may be used. The wired and wireless communication links may employ any suitable connection protocols such as Bluetooth, IEEE 802.11, Ethernet, or any other format or standard. The network 500, 508 may be configured to enable downloading of instruction sets (software) for games, game configuration data, game outcomes, from the central server(s) such as the server 508 to the gaming machines, and to enable uploading or downloading of marketing and operations data from the gaming terminals to the central server.

As shown at the bottom of FIG. 5, the game server 508 or network 500 may also serve wagering game devices and/or distribute content to devices located in other gaming establishment 540 or at other locations 544 such as a residence.

The server 508 may be any type computer capable of executing programs or instruction sets for controlling gaming machine, such as slot machines, video slots, or video poker machines, and communication with wireless devices. Although shown as a single server, numerous servers may be used. In such embodiments, the gaming machines 516, 524, 528 may each be a simple input/output terminal with regard to the functions controlled by the server 508. For example, the random selection of outcomes for the basic game and any bonus game may be functions performed by the server 508 and subsequently provided to a gaming machine. Functions that are not provided by the server 508, such as control of the local lights, sounds, and displays of the gaming machine, are handled by the local CPU within the gaming machine.

In this embodiment, a progressive or accumulated jackpot system is provided that includes a video or other type display 552 that is coupled to the network 500, 508. The display 552 is viewable by a number of players to present a total jackpot that is available for award upon receipt of a predetermined outcome. This type event may be referred to as community based events accessible from games on the gaming machines or from remote locations 540, 544 or gaming devices 528. For example, the display 552 may be used to show a current progressive jackpot or jackpots which players playing different gaming machines may be eligible to win. The display 552 may be any type display.

In one embodiment, the community event is a progressive award or jackpot, which is preferably linked with other gaming machines via the network 500, 508 and/or the network. The entire progressive award or jackpot may be won upon the occurrence of a certain outcome of the game. In other embodiment, the award is not fixed but instead the size of the award or jackpot is random such that when an award is triggered an RNG or other mechanism generates a random value which determines the amount, size, or type of prize. The prize or award may be monetary or a tangible item or service.

The server 508 may also operate one or more progressive awards concurrently with the basic game and/or bonus games. As explained above, such progressive awards are funded by appropriating a percentage of the coin-in from participating gaming machines. To be eligible to win the progressive award, the player may be required to make a progressive award side wager or make a wager satisfying predetermined criteria, e.g., a maximum wager or a wager covering all available paylines in the basic game. Then, upon occurrence of jackpot-won event in the form of either a "mystery" event or one or more predetermined outcomes in the basic game and/or bonus game, the player is awarded the progressive jackpot in addition to any regular prize or award resulting from the basic game and/or bonus game. The jackpot-won event may, for example, be the appearance of a predetermined scatter symbol during the basic game. A basic game menu may be part of the game disclosed herein and include several options for a player, including picking games, progressive options, and side bet options. Other community events may include a community bonus game, a bonus prize shared by multiple players, a multiplier award or other community features. Such a community event may interrupt the game play on the gaming machine and use other mechanisms such as the display 552 to show graphics or video relating to the community event. In this example embodiment, each one of the players who are currently playing wagering games on the gaming machines participates in the community event according to an eligibility criteria such as time-based eligibility that each gaming machine determines locally.

The server 508 includes a storage device that contains software instruction sets for different wagering games which may be loaded onto a memory of gaming machines. It is to be understood that different parts of the instruction sets may be stored on the memory with other parts of the instruction sets stored on the individual gaming machines. For example, the gaming machines may store part of the instruction sets in the form of modules relating to graphics files, audio/sound files, and certain game functions and operations such as player greetings or instructions. The stored instructions sets are mated with the remainder of the instruction sets loaded from the memory over the network 500.

Part or all of the software instruction set for wagering games may be sent to the various gaming machines via the wired communication links 500 or the wireless communication links 520. The wagering games may be stand alone or may offer eligibility or access to progressive awards or support other community events with other gaming machines on the network 500 or external networks 504.

The server 508 in this example stores a number of wagering games in the storage device. It is to be understood that part of the software to support the wagering games may already reside on the system memory of the gaming machine. For example, the modules responsible for RNG, audio and/or video drivers, etc. may reside on the system memory of the gaming machine. Other components of the instruction set of the game such as graphics files, audio files etc. may also reside in the storage device. Some or all of the instruction set may be loaded via the external I/O circuit from the network 500 such as from the storage device of the server 508. In this manner, the gaming machine may be used to play different games without requiring manual delivery of instruction sets different games to the gaming machine.

For example, a player may request a certain wagering game based on an initial display of a menu of wagering games displayed by the gaming machine. The menu may include some or all available wagering games stored on the server 508. Other background graphics and/or videos may be displayed on the primary display or the secondary display of the gaming machine to attract players to the gaming machine. The secondary display may be electronic or a secondary game to present a secondary game outcome. Based on the menu display 500, a player may select the desired game via a player input device such as the push buttons or touch screen buttons. Further, an operator of the casino may use the server to load wagering games to different gaming machines based on popularity, location, time interval, special events, schedule, etc.

Figure 6:
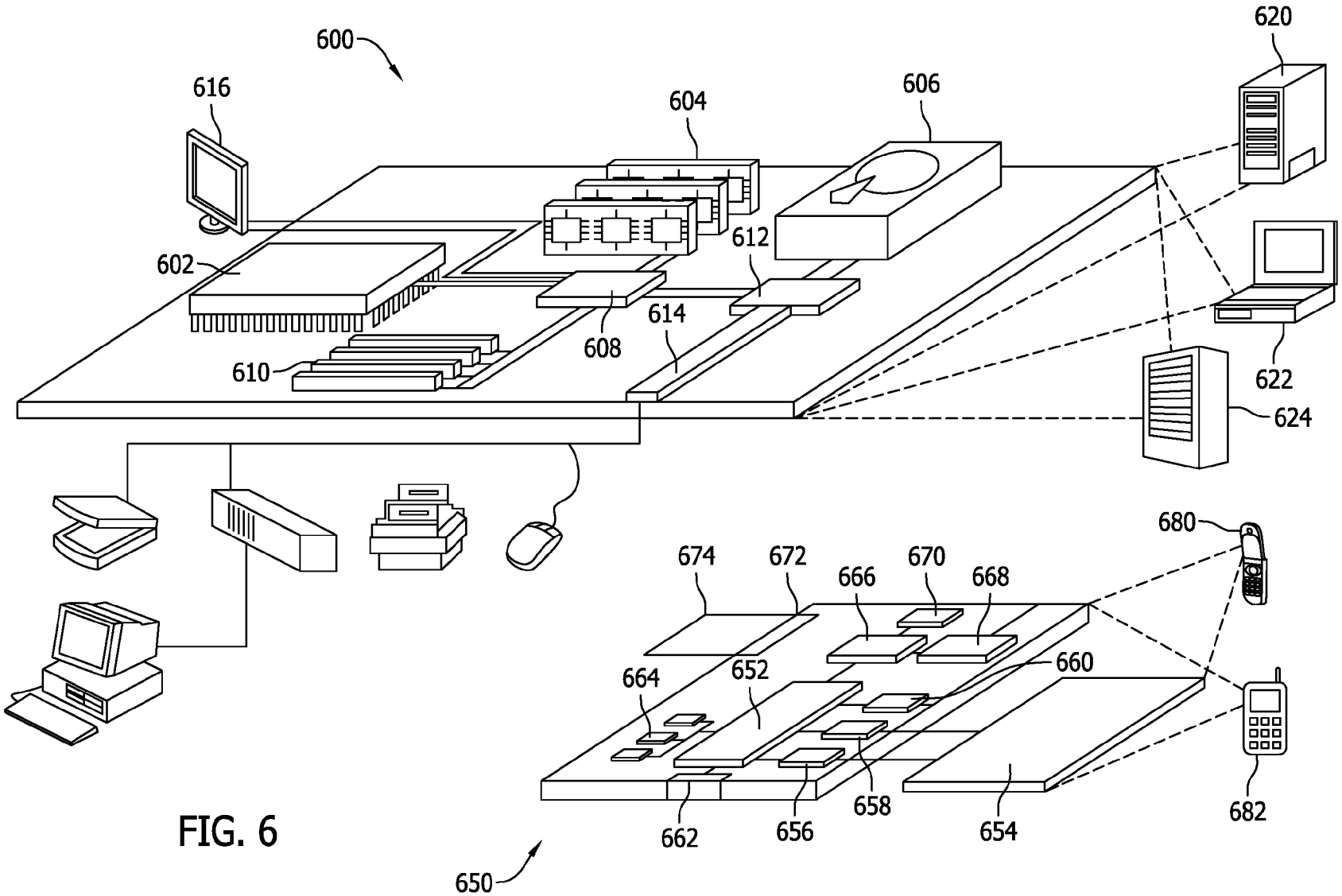
FIG. 6 illustrates an exemplary computing device, mobile device, gaming machine electronics in connection with networked devices.

FIG. 6 is a block diagram showing example or representative computing devices and associated elements that may be used to implement the systems method and apparatus described herein. FIG. 6 shows an example of a generic computing device 600 and a generic mobile computing device 650, which may be used with the techniques described here. Computing device 600 is intended to represent various forms of digital computers, such as laptops, desktops, workstations, personal digital assistants, servers, blade servers, mainframes, and other appropriate computers. Computing device 650 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 600 includes a processor 602, memory 604, a storage device 606, a high-speed interface or controller 608 connecting to memory 604 and high-speed expansion ports 610, and a low-speed interface or controller 612 connecting to low-speed bus 614 and storage device 606. Each of the components 602, 604, 606, 608, 610, and 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high-speed controller 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 604 stores information within the computing device 600. In one implementation, the memory 604 is a volatile memory unit or units. In another implementation, the memory 604 is a non-volatile memory unit or units. The memory 604 may also be another form of computer-readable medium, such as a magnetic or optical disk.

The storage device 606 is capable of providing mass storage for the computing device 600. In one implementation, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 604, the storage device 606, or memory on processor 602.

The high-speed controller 608 manages bandwidth-intensive operations for the computing device 600, while the low-speed controller 612 manages lower bandwidth-intensive operations. Such allocation of functions is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 606 and low-speed bus 614. The low-speed bus 614, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 650. Each of such devices may contain one or more of computing device 600, 650, and an entire system may be made up of multiple computing devices 600, 650 communicating with each other.

Computing device 650 includes a processor 652, memory 664, an input/output device such as a display 654, a communication interface 666, and a transceiver 668, among other components. The device 650 may also be provided with a storage device, such as a micro-drive or other device, to provide additional storage. Each of the components 650, 652, 664, 654, 666, and 668, are interconnected using various buses, and several of the components may be mounted on a common motherboard or in other manners as appropriate.

The processor 652 can execute instructions within the computing device 650, including instructions stored in the memory 664. The processor may be implemented as a chipset of chips that include separate and multiple analog and digital processors. The processor may provide, for example, for coordination of the other components of the device 650, such as control of user interfaces, applications run by device 650, and wireless communication by device 650.

Processor 652 may communicate with a user through control interface 658 and display interface 656 coupled to a display 654. The display 654 may be, for example, a TFT LCD (Thin-Film-Transistor Liquid Crystal Display) or an OLED (Organic Light Emitting Diode) display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may be provided in communication with processor 652, so as to enable near area communication of device 650 with other devices. External interface 662 may provide, for example, for wired communication in some implementations, or for wireless communication in other implementations, and multiple interfaces may also be used.

The memory 664 stores information within the computing device 650. The memory 664 can be implemented as one or more of a computer-readable medium or media, a volatile memory unit or units, or a non-volatile memory unit or units. Expansion memory 674 may also be provided and connected to device 650 through expansion interface 672, which may include, for example, a SIMM (Single In Line Memory Module) card interface. Such expansion memory 674 may provide extra storage space for device 650, or may also store applications or other information for device 650. Specifically, expansion memory 674 may include instructions to carry out or supplement the processes described above, and may include secure information also. Thus, for example, expansion memory 674 may be provided as a security module for device 650, and may be programmed with instructions that permit secure use of device 650. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 674, or memory on processor 652, that may be received, for example, over transceiver 668 or external interface 662.

Device 650 may communicate wirelessly through communication interface 666, which may include digital signal processing circuitry where necessary. Communication interface 666 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, Wifi, or other such transceiver (not shown). In addition, GPS (Global Positioning system) receiver module 670 may provide additional navigation and location-related wireless data to device 650, which may be used as appropriate by applications running on device 650.

Device 650 may also communicate audibly using audio codec 660, which may receive spoken information from a user and convert it to usable digital information. Audio codec 660 may likewise generate audible sound for a user, such as through a speaker, e.g., in a handset of device 650. Such sound may include sound from voice telephone calls, may include recorded sound (e.g., voice messages, music files, etc.) and may also include sound generated by applications operating on device 650.

The computing device 650 may be implemented in a number of different forms, as shown in the figure. For example, it may be implemented as a cellular telephone 680. It may also be implemented as part of a smart phone 682, personal digital assistant, a computer tablet, or other similar mobile device.

Thus, various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system (e.g., computing device 600 and/or 650) that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

In the example embodiment, computing devices 600 and 650 are configured to receive and/or retrieve electronic documents from various other computing devices connected to computing devices 600 and 650 through a communication network, and store these electronic documents within at least one of memory 604, storage device 606, and memory 664. Computing devices 600 and 650 are further configured to manage and organize these electronic documents within at least one of memory 604, storage device 606, and memory 664 using the techniques described herein.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It will be appreciated that the above embodiments that have been described in particular detail are merely example or possible embodiments, and that there are many other combinations, additions, or alternatives that may be included. For example, while online gaming has been referred to throughout, other applications of the above embodiments include online or web-based applications or other cloud services.

Also, the particular naming of the components, capitalization of terms, the attributes, data structures, or any other programming or structural aspect is not mandatory or significant, and the mechanisms that implement the invention or its features may have different names, formats, or protocols. Further, the system may be implemented via a combination of hardware and software, as described, or entirely in hardware elements. Also, the particular division of functionality between the various system components described herein is merely exemplary, and not mandatory; functions performed by a single system component may instead be performed by multiple components, and functions performed by multiple components may instead performed by a single component.

Some portions of above description present features in terms of algorithms and symbolic representations of operations on information. These algorithmic descriptions and representations may be used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "processing" or "computing" or "calculating" or "determining" or "identifying" or "displaying" or "providing" or the like, refer to the action and processes of a computer system, or similar electronic computing device, that manipulates and transforms data represented as physical (electronic) quantities within the computer system memories or registers or other such information storage, transmission or display devices.

Based on the foregoing specification, the above-discussed embodiments of the invention may be implemented using computer programming or engineering techniques including computer software, firmware, hardware or any combination or subset thereof. Any such resulting program, having computer-readable and/or computer-executable instructions, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM) or flash memory, etc., or any transmitting/receiving medium such as the Internet or other communication network or link. The article of manufacture containing the computer code may be made and/or used by executing the instructions directly from one medium, by copying the code from one medium to another medium, or by transmitting the code over a network.

While the disclosure has been described in terms of various specific embodiments, it will be recognized that the disclosure can be practiced with modification within the spirit and scope of the claims.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of playing a card game using a table and cards:

providing a physical deck of playing cards, the physical deck of playing cards comprising at least a fifty-two card deck;

providing a gaming table for playing of the card game in connection with the at least fifty-two card deck, the gaming table having a top surface for game play that has a community wild card printed on the surface and a community card area for placement of two or more community cards the community wild card pointed in the community card area;

receiving an first wager for a base game and an optional bonus event wager, the base game forming a five card hand and the bonus event wager based on a four card hand;

at the gaming table, dealing two cards to a player from the physical deck of playing cards as part of the base game and the bonus event and dealing a first community card and a second community card face down to a community card area;

receiving an second wager from the player;

revealing the first community card;

receiving an optional third wager during the base game responsive to the player not placing the optional third wager, determining if the player placed the bonus event wager and if the bonus event wager was placed, evaluating the player's four card hand comprising the two cards dealt to the player, the first community card, and the printed community wild card to determine if the four card hand is a winning outcome, such that if the four card hand is a winning outcome the player is provided an award;

responsive to the player placing the optional third wager, revealing the second community card; and evaluating the player's five card hand comprising the two cards dealt from the physical deck of playing cards to the player, the first community card from the physical deck of playing cards, the second community card from the physical deck of playing cards and the community wild card printed on the surface of the gaming table to determine if the five card hand is a winning outcome, such that if the five card hand is a winning outcome the player is provided an award, such that the only community cards from the physical deck of playing cards are the two cards dealt from the physical deck of playing cards to the player namely, the first community card from the physical deck of playing cards, the second community card from the physical deck of playing cards, and if the player placed a bonus event wager, evaluating the player's four card hand comprising the two cards dealt to the player, the first community card, and a community wild card to determine if the four card hand is a winning outcome, such that if the four card hand is a winning outcome the player is provided an award.

2. The method of claim 1, wherein the first wager must be the same amount as the second wager.

3. The method of claim 1, wherein the second wager is an optional wager.

4. The method of claim 1, wherein the award is proportional to the when wagers are placed in relation to revealing of the community cards.

5. The method of claim 1, wherein the community cards are shared with other players.

6. The method of claim 5, wherein the wild community card is printed on the gaming table.

7. A method of playing a card game using a gaming table and physical deck of physical cards:

providing the gaming table having a surface for playing of the card game in connection with the at least fifty-two card deck, the surface having a community card area and a community wild card printed on the surface in the community card area, the community wild card on the surface may be any card rank and value during play of the card game;

providing the physical deck of physical playing cards at the gaming table, the physical deck of playing cards comprising at least fifty-two cards;

receiving an first wager for a base game, the base game forming a base game card hand;

at the gaming table, dealing one or more physical cards to a player from the physical deck of playing physical cards and dealing one or more community cards to the community card area;

receiving an optional second wager from the player;

revealing a first community card from the one or more community cards;

receiving an optional third wager during the base game;

responsive to the player not placing the optional third wager, ending the base game and collecting wagers made by the player; and responsive to the player placing the optional third wager;

revealing at least a second community card from the one or more community cards wherein the first community card and the second community card are the only physical community cards from the physical deck of physical player cards placed on the table;

evaluating the player's card hand comprising the one or more cards dealt to the player, the one or more community cards, and the printed community wild card on the surface of the gaming table to determine if the base game card hand is a winning outcome, such that if the base game card hand is a winning outcome, providing the player an award.

8. The method of claim 7, further comprising:

receiving a bonus wager;

determining if the player placed the bonus wager;

if the bonus event wager was placed, evaluating a bonus card hand to determine if the bonus card hand is a winning outcome, the bonus card hand formed by fewer cards than the base game card hand; and if the bonus card hand is a winning outcome, providing the player an award.

9. The method of claim 7, wherein the base game card hand consists of four dealt cards and the community wild card printed on the table.

10. The method of claim 7, wherein the bonus card hand consists of three dealt cards and the community wild card.

11. The method of claim 7, wherein reshuffling occurs after each game or a newly shuffled deck is used for each base game.

12. The method of claim 7, wherein the first wager and the second wager must be of the same amount.

13. The method of claim 7, wherein the award provided to the player is related to a timing of the wagers.

14. A gaming machine comprising:

a controller;

at least one electronic display;

at least one player input device on the gaming machine;

a monetary acceptor configured to receive a ticket or monetary value from a player to establish credits on the gaming machine, the credits wagerable via the player input device;

a ticket-in and ticket-out device configured to accept and print tickets, the ticket representing monetary value which may be redeemed for credits at the gaming machine;

a memory storing machine-readable code, the machine-readable code executable by the controller to present a base game at the gaming machine the base game including the following steps:

receive first wager for a base game, the base game forming a base game card hand;

establish a deck of cards in the memory for use by the gaming machine, the deck of card representing at least one standard deck of playing cards;

display a wild community card on the display, the wild community card capable of being any rank and suit in a player hand and the wild community card not dealt from the deck of cards;

deal one or more cards to a player and display the one or more cards to the player on the electronic display and dealing one or more community cards to a community card area, the one or more community cards displayed on the electronic display face down;

receive an optional second wager from the player via the player interface;

reveal on the electronic display a first community card from the one or more community cards;

receive an optional third wager during the base game via the player interface;

responsive to the player not placing the optional third wager, ending the base game and collecting the first and second wager made by the player;

responsive to the player placing the optional third wager;

revealing on the electronic display at least a second community card from the one or more community cards;

evaluating the player's card hand comprising the one or more cards dealt to the player, the one or more revealed community cards, and a community wild card to determine if the base game card hand is a winning outcome, such that if the base game card hand is a winning outcome, providing the player an award.

15. The gaming machine of claim 14, wherein the machine readable code is further configured to:

receive a bonus wage via the player interface;

if the player placed the bonus wager, evaluate a bonus card hand to determine if the bonus card hand is a winning outcome, the bonus card hand formed by fewer cards than the base game card hand; and if the bonus card hand is a winning outcome, providing the player an award.

16. The gaming machine of claim 14, wherein the base game card hand consists of two cards dealt to the player, two community cards and the community wild card.

17. The gaming machine of claim 14, wherein the bonus card hand consists of two cards dealt to the player, one community card, and the community wild card.

18. The gaming machine of claim 14, wherein the machine readable code is configured to reshuffle after each game.

19. The gaming machine of claim 14, wherein the first wager and the second wager must be of the same amount.

20. The gaming machine of claim 14, wherein the award provided to the player is related to the number of wagers which are made.

* * * * *